US005533562A

United States Patent [19]

Moschini et al.

[11] Patent Number: 5,533,562

[45] Date of Patent: Jul. 9, 1996

[54] METHOD AND SYSTEM FOR SEMILIQUID DIE CASTING HIGH PERFORMANCE MECHANICAL COMPONENTS FROM RHEOCAST INGOTS

[75] Inventors: Renzo Moschini, Senigallia; Stefano Poggi, Sala Bolognese, both of Italy

[73] Assignee: Weber S.r.l., Turin, Italy

[21] Appl. No.: 315,236

[22] Filed: Sep. 29, 1994

[30] Foreign Application Priority Data

Sep. 29, 1993 [IT] Italy ..... TO93A0709

[51] Int. Cl.[6] ..... B22D 27/08; B22D 17/08

[52] U.S. Cl. ..... 164/71.1; 164/113; 164/154.6; 164/312; 164/900

[58] Field of Search ..... 164/900, 71.1, 164/4.1, 113, 312, 80, 457, 151.5, 154.6, 72, 61, 267, 253

[56] References Cited

U.S. PATENT DOCUMENTS 4,310,352 1/1982 Manfre ..... 75/93 R
4,537,242 8/1985 Pryor et al. ..... 164/900

FOREIGN PATENT DOCUMENTS 0217075 12/1984 European Pat. Off. .
0411329 2/1991 European Pat. Off. .
0513523 11/1992 European Pat. Off. .
0590402 4/1994 European Pat. Off. .
1-254364 10/1989 Japan ..... 164/900

OTHER PUBLICATIONS

Metallurgical Transactions, vol. 22B, No. 1, Feb. 1991, M. C. Flemmings, "Behavior of Metal Alloys in the Semisolid State", pp. 287–291.

*Primary Examiner*—Kuang Y. Lin
*Attorney, Agent, or Firm*—Baker & Daniels

[57] ABSTRACT

A method including a preheating stage wherein rheocast light alloy ingots are preheated to a temperature within the solidification range of the alloy; and a die casting stage wherein a mold is filled with the semiliquid alloy. The preheating stage is performed in a forced-convection-heated tunnel furnace, with the ingots housed inside cup-shaped containers which, following a temperature check, are tipped by a robot to unload the ingots into the injection chamber of a die casting machine. Work is conducted within a temperature range depending on the composition of the alloy, and such that, at the minimum permissible injection temperature, the ingot is incapable of maintaining its own shape, and, at the maximum permissible injection temperature, the apparent viscosity of the ingot is such as to ensure the mold is filled under laminar flow conditions.

11 Claims, 7 Drawing Sheets

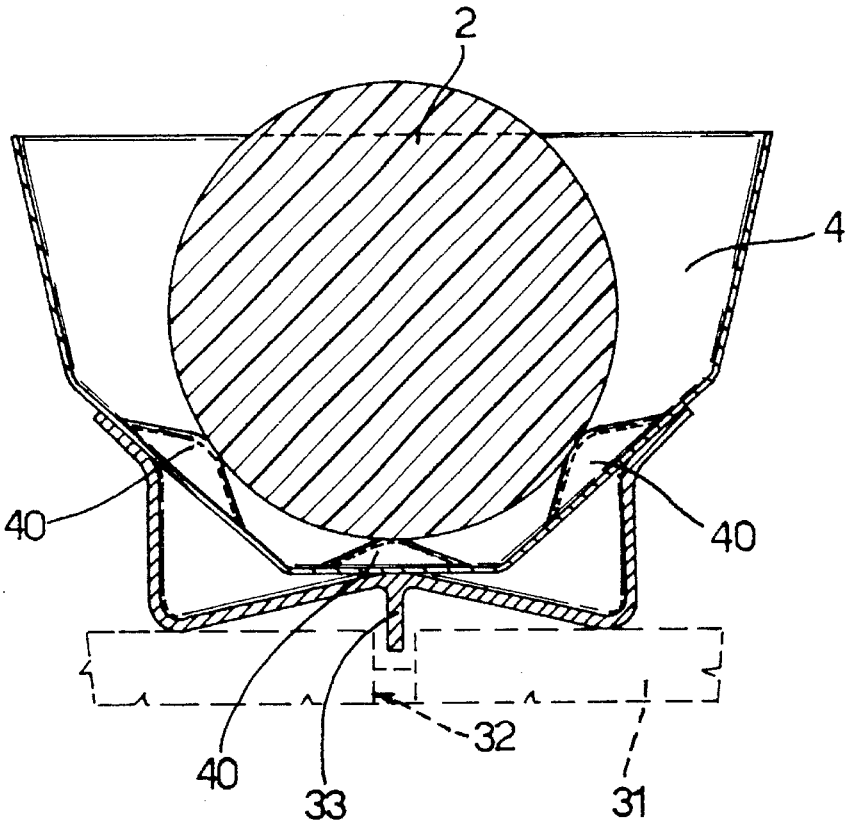
Fig.4
Fig.5
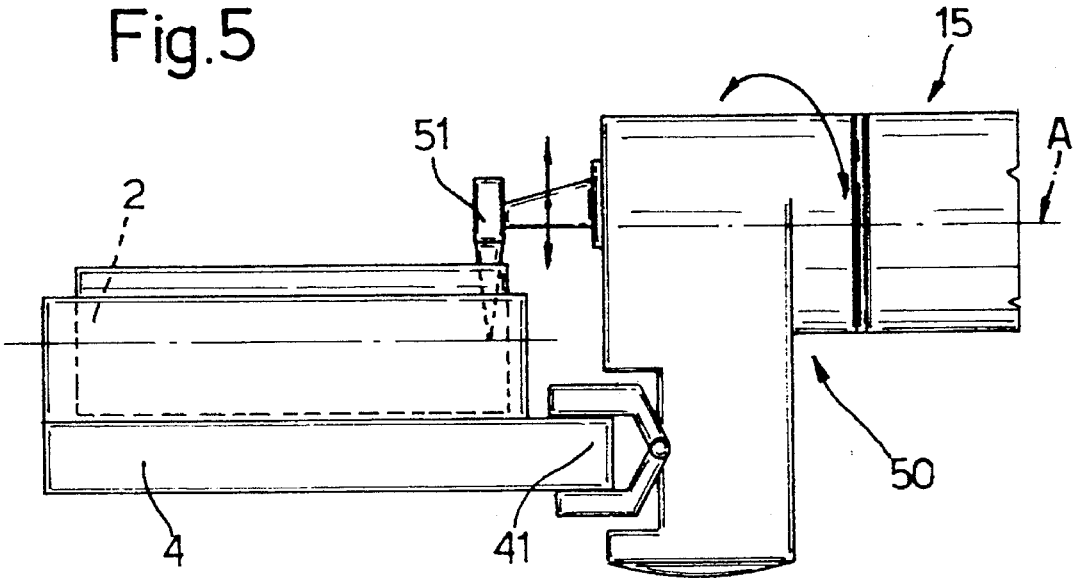

METHOD AND SYSTEM FOR SEMILIQUID DIE CASTING HIGH PERFORMANCE MECHANICAL COMPONENTS FROM RHEOCAST INGOTS

BACKGROUND OF THE INVENTION

The present invention relates to a method and system for low-cost, reliable semiliquid die casting of high performance mechanical components, particularly vehicle injection system parts, from rheocast light alloy ingots.

Italian Patent n. 1.119.287 filed on 20 Jun., 1979, and entitled: "Process and device for preparing a metal alloy mixture comprising a solid and liquid phase", the content of which is expressly incorporated herein by reference, relates to a static mixer for bringing a metal alloy into a "semiliquid" state in which the alloy, though already within the solidification range, can be cast, and presents a homogeneous composition and appearance as though still fully liquid.

More recent studies (R. L. Antona–R. Moschini: Met. Sci. Technol., 1986, vol.4 (2), p. 49–59; M. C. Flemings: Met. Transactions B, June 1991, vol.22 (B), p. 269–293) have shown that, when solidified, semiliquid cast light alloys—known as "rheocast" alloys—present a characteristic microstructure—a globular as opposed to the normal dendritic structure—resulting in a characteristic behaviour of the alloy when restored to a temperature within the solidification range. More specifically, rheocast alloys with a globular structure tend to segregate eutectic liquid and reassume a semiliquid state in which the alloy presents a characteristic "dessert cream" consistency.

In the "semiliquid" state, rheocast alloys have also been found to be pseudoplastic in the sense that viscosity varies (decreases) alongside a variation (increase) in the applied shear rate. According to Italian Patent Application n. TO91A000299 filed on Oct. 4, 1991 by the present Applicant and entitled: "Process for producing high mechanical performance die castings via injection of a semiliquid metal alloy", the content of which is expressly incorporated herein by reference, the pseudoplastic behaviour of rheocast alloys is exploited for producing good quality, sound die castings from semiliquid alloys.

Transferring semiliquid die casting technology to mass production, however, presents more than a few problems. Foremost of these is the difficulty in ensuring the die casting machine has a continuous supply of ingots within a suitable temperature range. Such a continuous supply within the suitable temperature range is necessary to prevent no-load injection and hence damage to the machine for lack of the ingot, and to prevent the alloy from being injected in less than optimum rheological conditions (due to over- or underheating), the latter being a fairly common occurrence due to the widely varying Reynolds number relative to the variation in the viscosity of the metal alloy for a given gate section of the die casting machine.

The method described by Flemings (M. C. Flemings: Met. Transactions B, June 1991, vol. 22 (B), p. 269–293), whereby rheocast ingots are produced by magnetic agitation and inductive preheating to the die casting temperature, imposes an extremely narrow preheat temperature range (i.e., a range corresponding to the presence of 50% solid fraction ±0.5° C.), poses problems as regards handling of the ingots (induction heating rules out the use of containers, so that the ingots must be handled as solids), and poses serious difficulties in obtaining complete finished castings with the required degree of soundness. And even if this were possible, the castings would contain too many gaseous inclusions for them to be heat treated.

SUMMARY OF THE INVENTION

It is an object of the present invention to provide a mass production method of semiliquid die casting high mechanical performance components—particularly vehicle injection system parts—from rheocast ingots, and which provides for overcoming the aforementioned drawbacks. In particular, it is an object of the present invention to provide a method which is low-cost, easy to implement, and can be applied to standard production lines.

According to the present invention, there is provided a method of producing high mechanical performance components from rheocast ingots via semiliquid die casting of a metal alloy; the method comprising a stage consisting of preheating the rheocast ingots to a temperature within the solidification range of the alloy, so as to bring the alloy to a semiliquid state; and a die casting stage wherein a mold is filled with the alloy in the semiliquid state; the preheating stage being performed in a furnace with the ingots housed inside respective cup-shaped containers; characterized in that:

the preheating stage is performed in a forced-convection-heated furnace; and the preheated ingots are withdrawn from the furnace, and, by gripping the respective said cup-shaped container, are transferred to a die casting machine and tipped into the injection chamber of the die casting machine by tipping the container and controlling the temperature of the alloy by immersing a thermocouple in the respective ingot during transfer;

said operations being performed within a temperature range determined by the composition of the alloy and such that, at the minimum permissible injection temperature, the ingot begins to be visibly incapable of maintaining its own independent shape, and, at the maximum permissible injection temperature, the apparent viscosity of the ingot is such as to ensure the mold is filled under laminar flow conditions at the casting pressure.

This therefore provides for establishing definite, easily detectable parameters, on the basis of the chemical composition of the alloy, for determining the castability of the semiliquid alloy ingot, ensuring the production of extremely sound castings, and so providing for a negligible number of rejects. Tests conducted by the Applicant have shown that using a forced convection furnace and measuring the temperature of the ingot during transfer by immersion of a thermocouple therein represents a combination enabling operation on an industrial scale with no plant stoppages or no-load injection operations, and with a minimum number of rejected preheated ingots thereby achieving a low running cost and high output.

Also, by virtue of the above limitations and the use of a container for handling the ingots in which segregated eutectic liquid is retained (thus preventing a variation in the composition of the alloy), it is possible in practice to operate within ±7° C. of the temperature corresponding to the presence of a 50% solid fraction in the alloy (a temperature range compatible with many industrial facilities), as opposed to ±0.5° C. of the Flemings process.

According to a further characteristic of the present invention, the semiliquid alloy injection stage is performed using a mold maintained at a temperature within a predetermined range, well above ambient temperature and more specifically between 250° C. and 350° C., by independent preheating means with which the half molds of the die casting machine are equipped.

This provides for achieving desired temperature gradients inside the mold and, at any rate, for ensuring a very small temperature differential between the solidifying semiliquid alloy and the mold walls, thus substantially eliminating shrinkage during solidification—to which aluminium alloys are particularly subject—and drastically reducing wear of the (steel) mold. Also contributing towards reducing wear of the mold is the limited extent to which the alloying elements of steel are dissolved by a semiliquid aluminium alloy filling the mold under laminar flow conditions, as compared with a fully liquid aluminium alloy.

Preferably, the half molds are lubricated, and the mold is closed and a vacuum formed inside by means of a vacuum pump before injecting the semiliquid alloy.

This provides, on the one hand, for troublefree removal of the finished casting and, on the other, for eliminating the counterpressure exerted by any air (or lubricant vapours) when injecting the semiliquid alloy into the mold, and so preventing the formation of swirl or microholes.

According to the present invention, there is also provided a system for producing high performance mechanical components, in particular vehicle fuel injection system parts, from rheocast ingots via semiliquid die casting of a metal alloy; the system comprising a furnace for preheating the ingots to a temperature within the solidification range of said metal alloy; a number of cup-shaped containers for the ingots; and a die casting machine in turn comprising an injection chamber for receiving the preheated ingots one at a time; and a mold composed of at least two half molds movable in relation to each other; characterized in that said furnace is a tunnel furnace wherein the ingots, each housed inside a respective said cup-shaped container, are fed in steps in a number of side by side rows; and in that said system also comprises a loading station located at a first end of the tunnel furnace and served by a first robotic handling device for inserting the ingots inside respective containers and loading them side by side in a predetermined number on to the loading station for simultaneous insertion into the furnace; an unloading station located at a second end, opposite the first end, of the furnace, and which, upon the side by side ingots in the various rows being aligned against a limit stop, provides for withdrawing the ingots from the furnace; a second robot handling device traveling between the unloading station and said die casting machine, and which provides for transferring the ingots one at a time by gripping the respective container, and for selectively tipping each ingot into said injection chamber or a reject bin by tipping the respective container; and control means for measuring the temperature of the semiliquid alloy during transfer by the second handling device, and accordingly controlling the second handling device; said control means comprising a thermocouple which is immersed inside the ingot during transfer by the second handling device.

BRIEF DESCRIPTION OF THE DRAWINGS

A non-limiting embodiment of the present invention will be described by way of example with reference to the accompanying drawings, in which:

FIG. 4 shows a larger-scale detail in section of the manner in which the ingots are handled in the FIG. 1 system;

FIG. 5 shows a schematic detail of a handling device in the FIG. 1 system at one stage in the method according to the present invention.

DETAILED DESCRIPTION OF THE INVENTION

Figure 1:
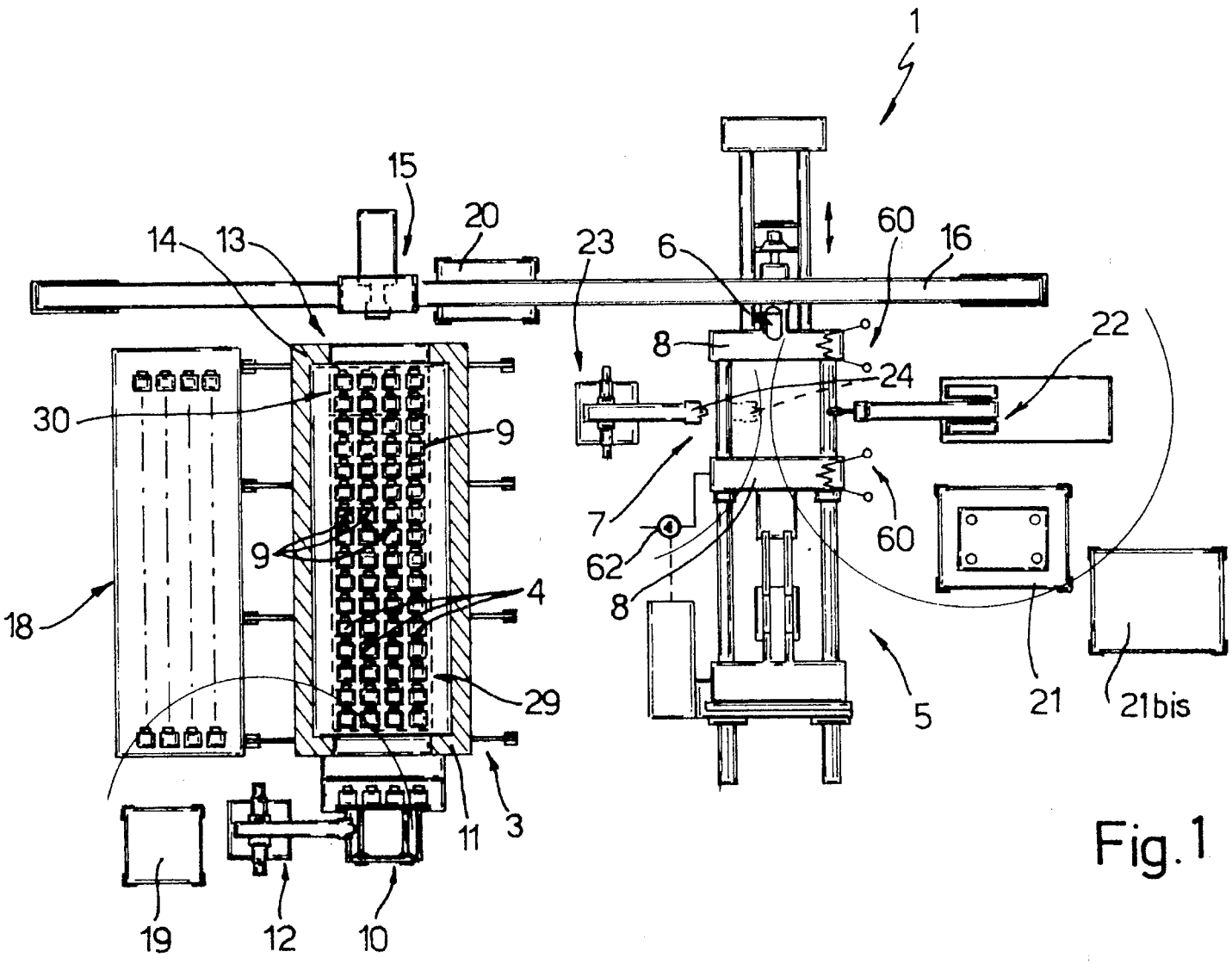
FIG. 1 shows a schematic top plan view of a system in accordance with the present invention.

With reference to FIGS. 1 to 4, number 1 indicates a system for semiliquid die casting a metal alloy from rheocast ingots 2, for producing high performance mechanical components, in particular vehicle fuel injection system parts such as the fuel manifold and similar parts. Ingots 2 are preferably formed using the process described in Italian Patent Application n. TO92A000791 filed by the present Applicant on 29/09/1992, and entitled: "Process for producing rheocast ingots, particularly for producing high mechanical performance die castings", the content of which is expressly incorporated herein by reference.

System 1 comprises a furnace 3 for preheating ingots 2 to a temperature within the solidification range of the metal alloy (in the non-limiting example described, an aluminium alloy with 7% silicon); a number of cup-shaped containers 4 for ingots 2; and a known die casting machine 5 in turn comprising an injection chamber 6 for receiving preheated ingots 2 one at a time; and a mold 7 composed of at least two half molds 8 movable in relation to each other.

Figure 2:
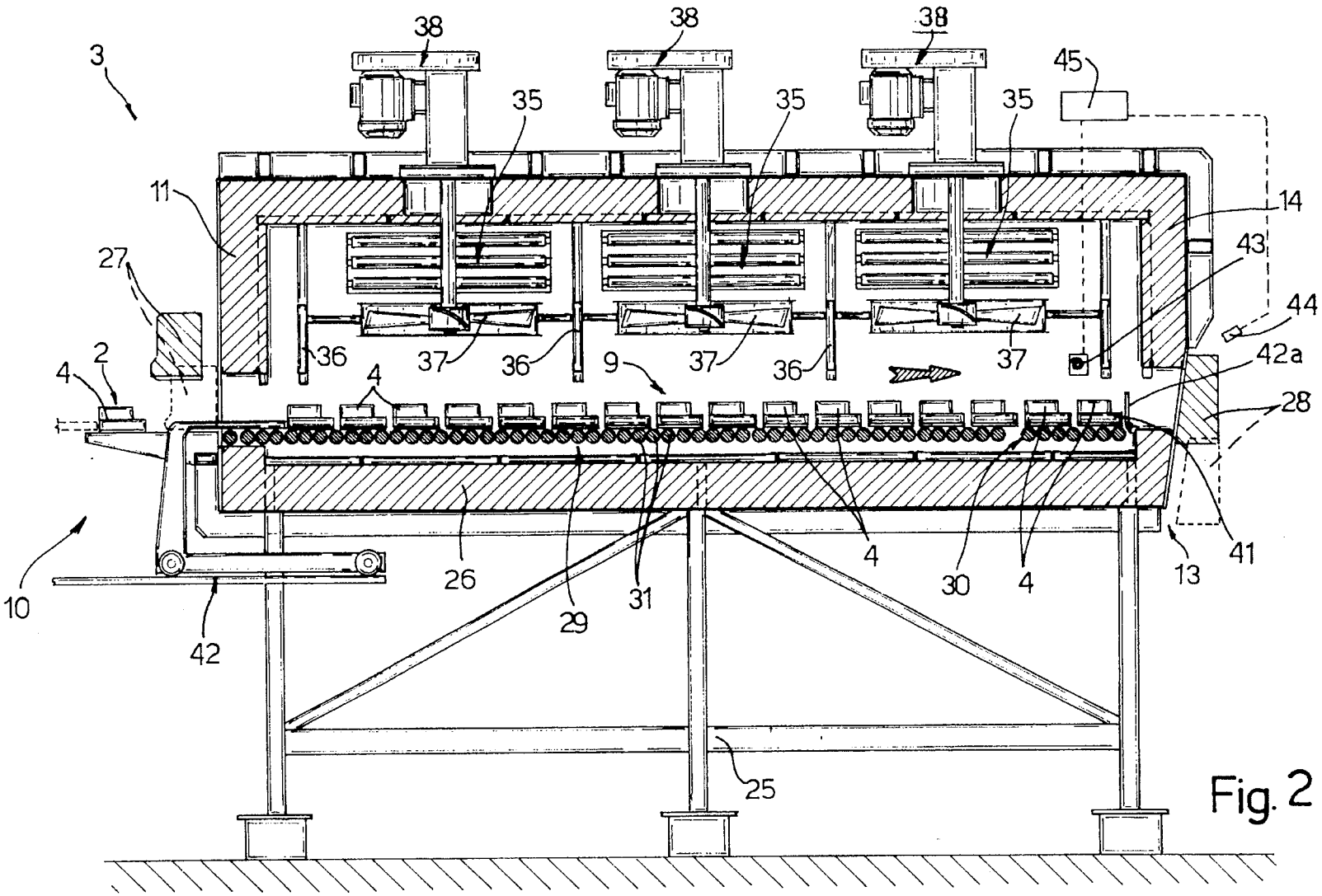
FIGS. 2 and 3 show larger-scale longitudinal and front sections respectively of the preheat furnace in the FIG. 1 system.

According to the present invention, furnace 3 is an electrical forced-convection-heated tunnel furnace wherein ingots 2, each housed inside a respective container 4, are fed in steps in the direction shown by the arrow in FIG. 2, and in a number of side by side rows 9—in the example shown, four side by side rows 9, each composed of sixteen containers 4 aligned in the traveling direction of ingots 2.

System 1 also comprises a loading station 10 located at a first end 11 of furnace 3, and served by a first robotic handling device 12; an unloading station 13 located at end 14, opposite end 11, of furnace 3; and a second robotic handling device 15 traveling between unloading station 13 and die casting machine 5 along a known rail 16. System 1 is completed by a roller conveyor 18 alongside furnace 3, for returning and recirculating the empty containers 4; a known automatic store 19 for ingots 2 for supply to system 1; a bin 20 for rejected ingots 2; a vertical shear 21 for trimming the castings and served by a robot handling device 22 for removing the rough components off machine 5 and depositing them inside a respective store **21*bis*; and a third robot 23 with a head 24 movable between the positions shown by the continuous and dotted lines in FIG. 1, for lubricating half molds 8**.

Figure 3:
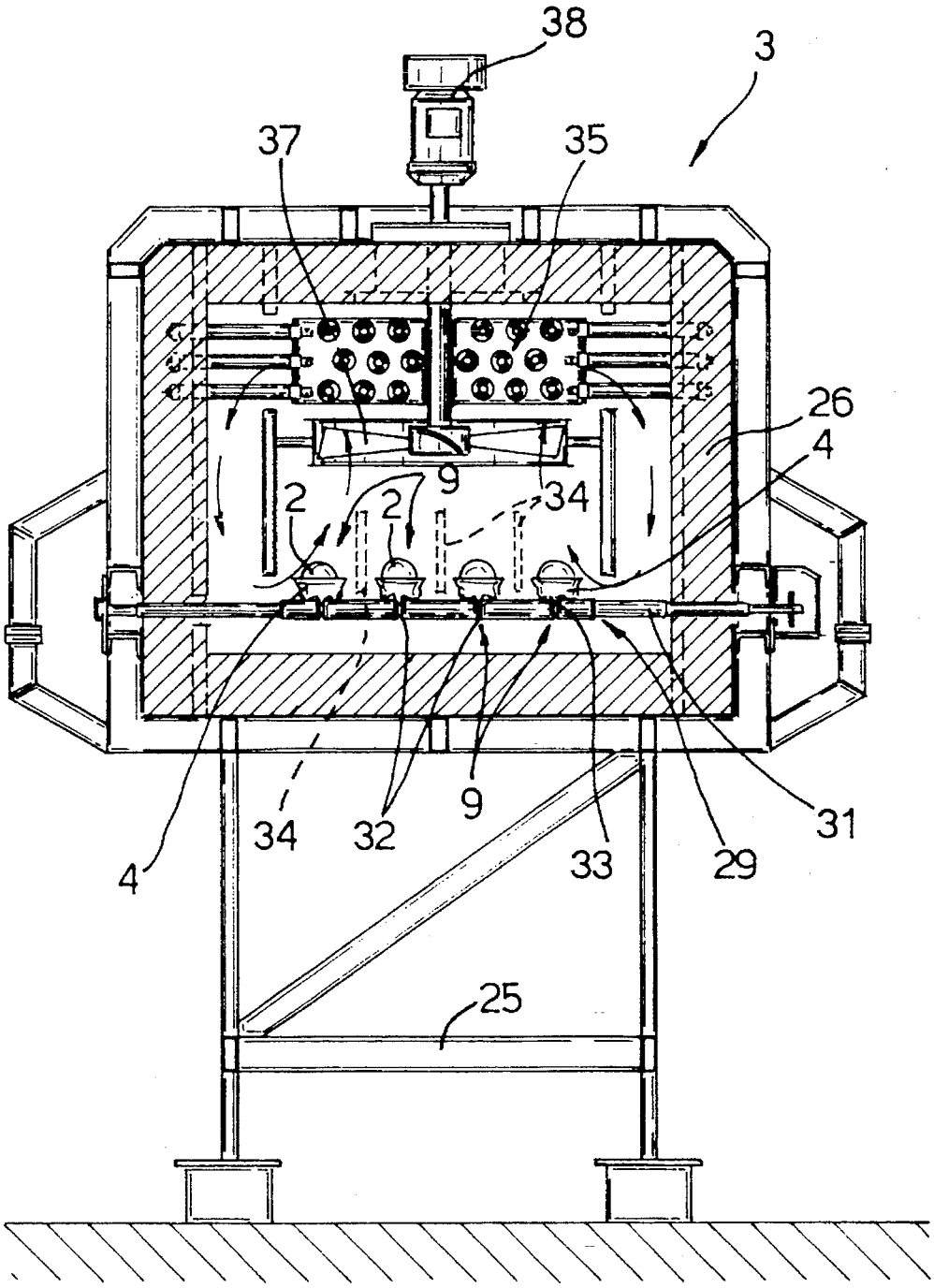

With particular reference to FIGS. 2 and 3, furnace 3 is mounted on a frame 25, and comprises a shell 26 made in known manner of refractory material and sheet steel; an inlet opening at end 11, with a door 27 movable between an open position (continuous line) and a closed position (dotted line); an outlet opening at end 14, with a door 28 movable between an open position (dotted line) and a closed position (continuous line); and a first and second powered roller conveyor 29 and 30, for supporting containers 4 and transferring ingots 2 by friction along the furnace, between ends 11 and 14.

More specifically, roller conveyors 29 and 30 are arranged in series, conveyor 30 adjacent to end 14, and are powered independently, e.g. by separate known motors (not shown) which rotate the respective cylindrical rollers 31 of the conveyors for predetermined times. According to one characteristic of the invention, roller conveyors 29, 30 present means for guiding ingots 2 in the traveling direction and controlling their transverse movement, and which, in the example shown, comprise respective annular grooves 32 (FIG. 4) formed on the outer lateral surface of rollers 31, forming an extended groove in the travel direction, and engaged by respective guide tabs 33 integral with and projecting from the bottom of containers 4. Provision may be made for further, optional, guide means consisting of longitudinal walls 34 (shown by the dotted line in FIG. 3) defining barriers for separating the containers 4 in adjacent rows 9.

Furnace 3 also comprises heating means defined, according to the invention, by a number of sets of electric resistors 35 separated by partition walls 36 and arranged in series in the traveling direction of ingots 2 (arrow in FIG. 2) along furnace 3. Each set of resistors 35 is supplied separately in known manner, presents its own known temperature control means (not shown), and is served by a known fan 37 powered in known fluidtight manner through shell 26 by a respective motor 38 outside furnace 3. As such, furnace 3 is divided longitudinally, in the traveling direction of ingots 2, into a number of independently-temperature-controlled sections in which a turbulent air stream is force-circulated between resistors 35 and roller conveyors 29, 30 as shown schematically by the arrows in FIG. 3.

According to a further characteristic of the invention, to assist uniform heating of ingots 2 to a temperature as close as possible to that determined in each furnace section by respective resistors 35 and fan 37, containers 4—made of pressed stainless steel sheet—present internal projections 40 (FIG. 4) for supporting ingot 2 with a predetermined clearance between it and the inner surface of container 4, and so enabling forced air circulation about the ingot until it reaches a temperature at which it is no longer capable of maintaining its own independent shape, and gradually slumps on to the bottom of container 4 where any segregated eutectic liquid is also collected.

With reference also to FIG. 5, each container 4 presents a projecting appendix 41 which is gripped by robots 12 and 15 for handling the container with or without ingot 2 inside. Robot 12 cooperates with station 10, and provides for removing containers 4 off the end of conveyor 18 adjacent to end 11, and depositing them side by side on to station 10, as well as for withdrawing ingots 2 at ambient temperature from store 19, and depositing them inside the empty containers 4 (this may be done indifferently while the containers are still on conveyor 18 or after they have been deposited on to station 10). At this point, door 27 is opened, and four containers 4 housing respective ingots 2 are fed simultaneously on to roller conveyor 29 in furnace 3 by means of a push device 42 (FIG. 2) at station 10.

Once inside furnace 3, ingots 2 are fed side by side and in steps along the furnace towards end 14, by activating roller conveyor 29 for a predetermined time, and then stopping it for a predetermined interval during which a further four containers and respective ingots are loaded by robot 12 on to station 10 and fed into furnace 3 into the place vacated by the previous containers 4 which in the meantime have been fed a given distance along roller conveyor 29. Ingots 2 are thus fed (in about 50–60 minutes) on to roller conveyor 30 at end 14, and are gradually forced-convection-heated (by the combined action of resistors 35 and fans 37) within the desired temperature range. Containers 4 with respective heated ingots 2 are then removed off roller conveyor 30 by robot 15 as described below, so that, in the steady operating condition, furnace 3 simultaneously contains four rows of sixteen containers 4 and respective ingots 2, as shown in FIG. 1.

Unloading station 13 (FIG. 2) comprises roller conveyor 30; a movable limit stop 42*a*; and known sensors 43 and 44 located respectively inside and outside furnace 3, for detecting the presence of containers 4, and connected to a known control unit 45, e.g. a PLC, for controlling operation of robots 12, 15, roller conveyors 29, 30, limit stop 42*a* and machine 5. Upon each group of side by side containers 4 reaching the end of roller conveyor 29, it is pushed, at the next operating step of conveyor 29, on to conveyor 30 where, due to different amounts of slippage during transportation, the containers 4 in each group may not be perfectly aligned. This is therefore corrected by unit 45 raising limit stop 42*a* and operating roller conveyor 30 until all the containers 4 in each group, sliding along conveyor 30, are successively arrested and aligned against limit stop 42*a*.

Upon alignment of containers 4 being detected by sensor 43, unit 45 stops roller conveyor 30, removes limit stop 42*a*, and, for each operating cycle of machine 5, opens door 28 and, using the output of sensor 44, controls robot 15 to successively remove the four containers in each group, which are then replaced by the next group of four containers. More specifically, robot 15 presents a head 50 rotating about an axis A; is fitted in movable manner with a known immersion thermocouple 51; and presents gripping means for gripping containers 4 one at a time by means of appendix 41, as shown schematically, for example, in FIG. 5. Thermocouple 51 is connected in known manner to control unit 45, and is immersed inside ingot 2 heated to softening temperature and housed inside the container 4 gripped by robot 15. Also controlled by unit 45, head 50 rotates at least 180° about axis A to enable robot 15 to tip the gripped container 4 downwards and, as commanded by control unit 45, selectively tip the preheated ingot into injection chamber 6 or reject bin 20 as robot 15 travels along rail 16.

According to a further characteristic of the invention (FIG. 1), half molds 8 include independent preheating means, e.g. a number of electric heater plugs 60 (shown schematically), for maintaining mold 7, during the die casting operation, within a predetermined temperature range well above (over 100° C. above) ambient temperature. System 1 also comprises a suction pump 62 connected internally to mold 7 and which, when the mold is closed, i.e. when half molds 8 are brought together, provides for withdrawing the air and any gas from inside mold 7 and so forming a vacuum inside the mold prior to die casting.

By means of system 1, the present invention provides for a semiliquid die casting method capable of ensuring low-cost production of extremely sound castings from ingots 2 and with a very small number of rejects. The method substantially comprises a stage consisting of preheating ingots 2 to a temperature within the solidification range of the alloy, and a semiliquid die casting stage consisting of depositing the preheated ingot 2 inside the injection chamber 6 of a conventional die casting machine 5 except for the 100% increase in the size of the gate, includes three basic characteristics: firstly, the preheating stage is performed in a forced-convection-heated furnace 3; secondly, the preheated ingots 2 are handled exclusively by means of containers 4, and temperature control for determining the castability of the ingot is performed during transfer to machine 5 and by immersing thermocouple 51 down to the barycenter, i.e. the geometric axis, of the ingot; and thirdly, each operation is performed within a temperature range dependent on the composition of the alloy but nevertheless fairly wide and determined as a function of two easily definable parameters as shown in the FIG. 6, 7 and 8 graphs.

Figure 6:
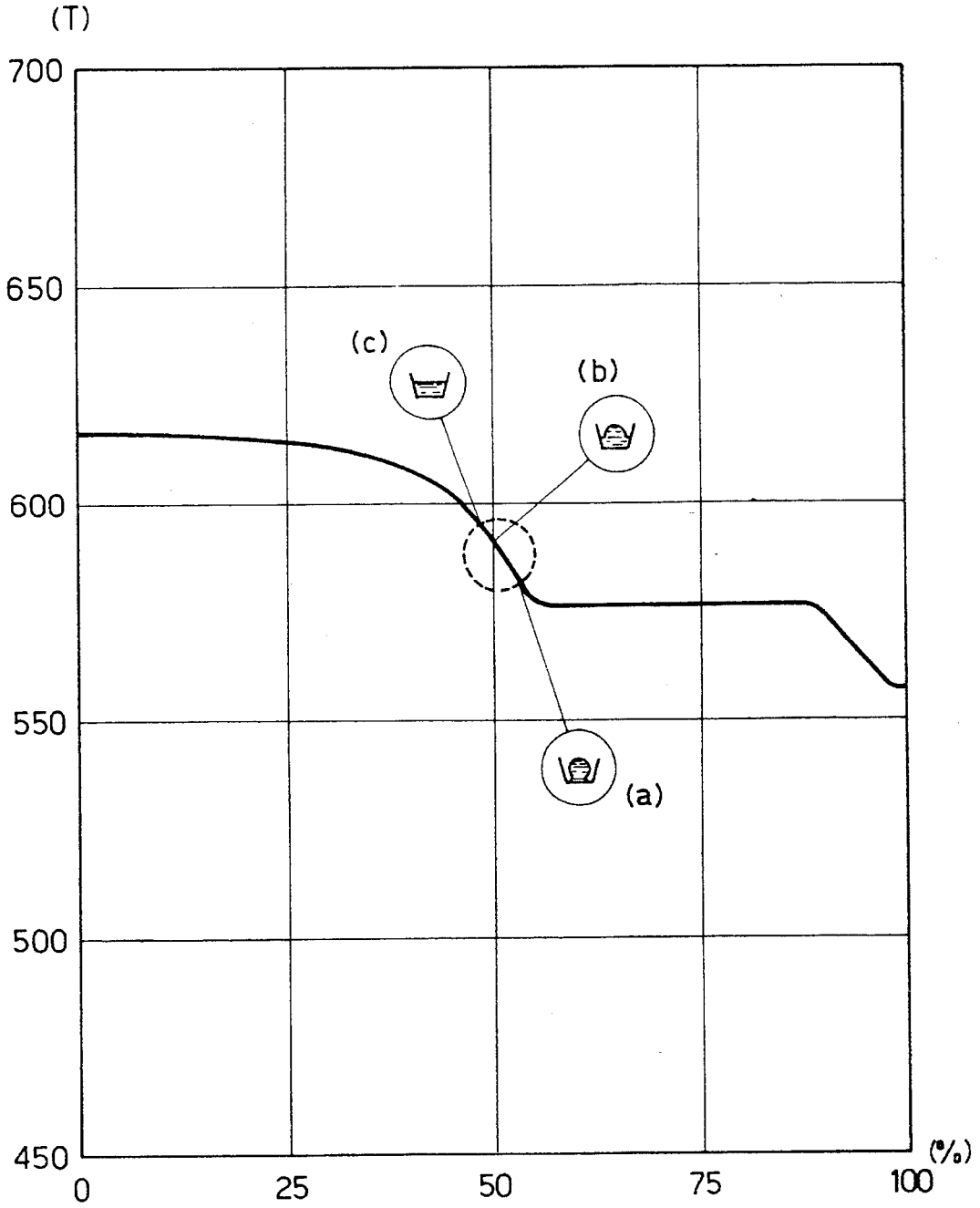
FIGS. 6, 7 and 8 show ideal process condition graphs according to the method of the present invention.
Figure 7:
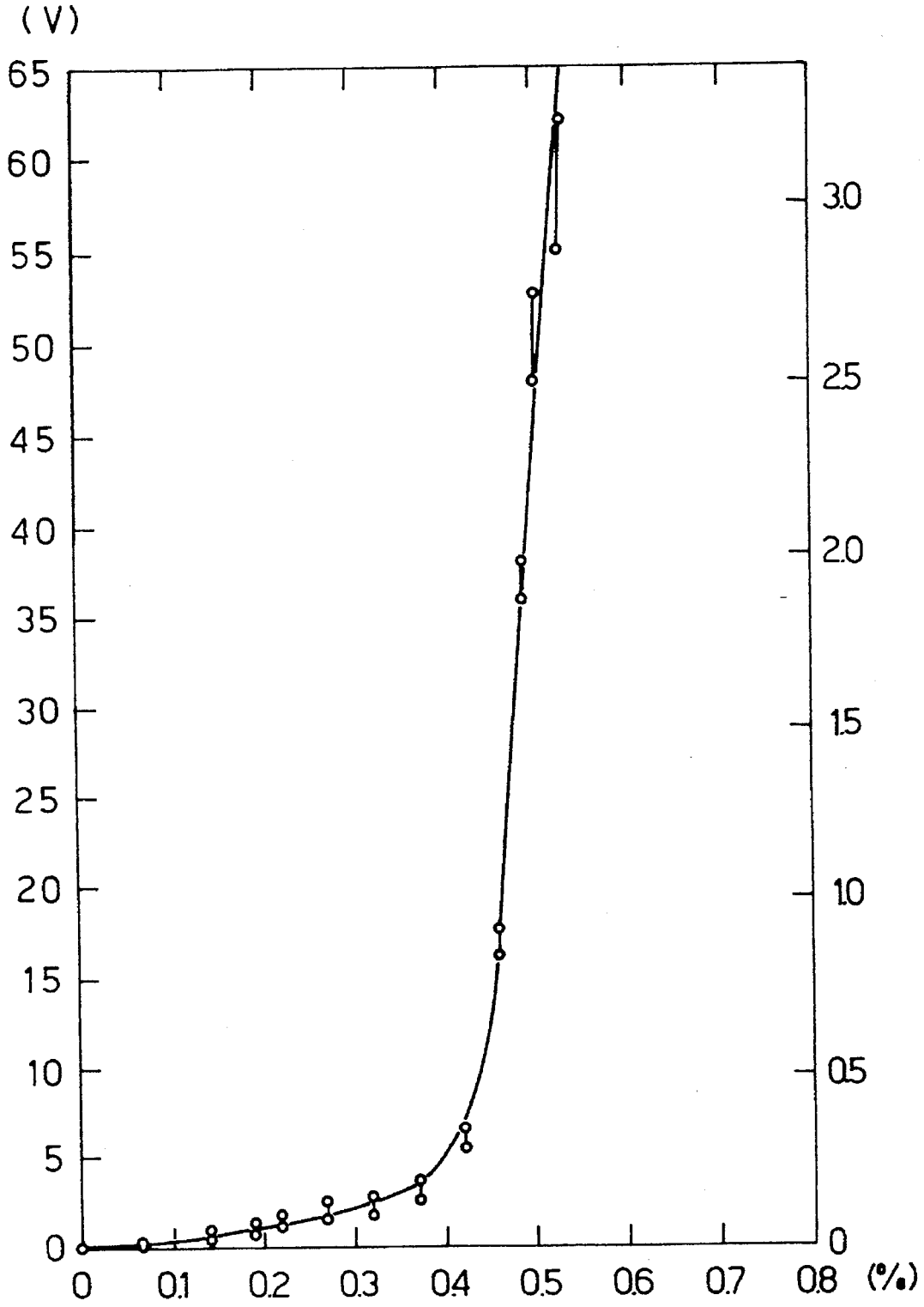
Figure 8:
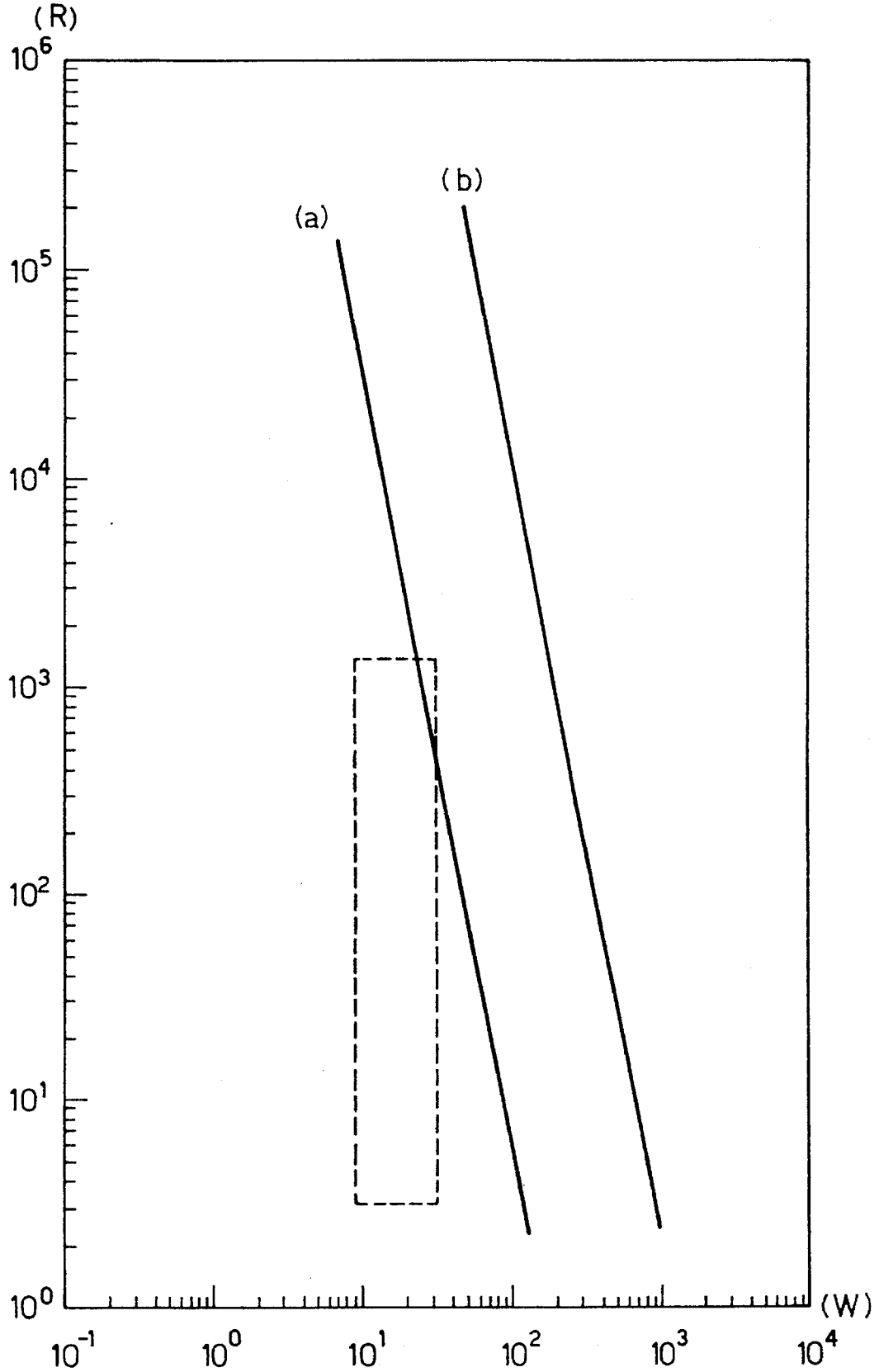

With reference to FIGS. 6, 7 and 8, which show test graphs using UNI3599 (US designation A365) aluminium alloys with 7% by weight of silicon and 0.3% by weight of magnesium, FIG. 6 shows the solidification curve of the alloy in terms of temperature (T) and solid fraction (%); FIG. 7 shows the relationship between apparent viscosity (V), measured in Poise, and solid fraction (%) (the apparent viscosity of a pseudoplastic fluid, such as the test alloys in the semiliquid state, is intended to mean the viscosity presented upon application of a predetermined shearing stress); and FIG. 8 shows the rheological curves (in logarithmic scale) of the alloy (Reynolds number R in relation to Weber number W). FIG. 6 also shows, schematically, the appearance of ingot 2 inside container 4 at different points of the solidification curve.

According to the method of the present invention, assuming as the mid temperature within the castable ingot temperature range that of point (b), at which 50% by weight of solid is present (and corresponding to 590° for the alloy in the example shown), the minimum injection temperature (i.e. for insertion of ingot 2 into chamber 6) is that of point (a), i.e. the temperature (583° C. for the test alloy, with a 55% solid fraction) at which ingot 2 is visibly no longer capable of maintaining its shape under its own weight, and begins to "slump" on to the bottom of container 4; while the maximum injection temperature is that of point (c) corresponding, for the test alloy, to 597° C. with a solid fraction of 45%, and at which ingot 2 no longer has any shape of its own and assumes that of container 4 already in the manner of a liquid, albeit of high viscosity, and the apparent viscosity of the alloy constituting ingot 2 is the minimum for ensuring mold 7 is filled under laminar flow conditions at the casting pressure. For the alloy in question, this corresponds to the area shown by the dotted line in FIG. 8, i.e. to minimum apparent viscosity under roughly 1 Poise injection conditions.

In other words, the minimum permissible temperature for casting each alloy using the method according to the present invention is that at which the ingot visibly begins to soften; while the maximum temperature, as shown in the rheological graph of the alloy, is that ensuring operation to the left of curve (a) in FIG. 8, i.e. laminar-flow mold fill conditions (turbulent flow conditions occurring to the right of curve (b), and transition conditions between curves (a) and (b)). In the example shown, the method according to the present invention therefore provides for preheating and injecting the semiliquid alloy within a wide temperature range (590° C.±7° C.) and for operating entirely outside the conditions considered optimum by Flemings, i.e. in which ingot 2 can still be handled as though it were solid ($10^7$ Poise, equivalent to the viscosity of butter at room temperature), and corresponding, for the alloy in question, to a temperature of 580° C. and an operating range of no more than ±0.5° C.

According to the present invention therefore, after first establishing the permissible temperature range as a function of the composition of the alloy and with the aid of graphs as in FIGS. 6–8, this data is loaded into control unit 45, and ingots 2 are preheated in furnace 3 as already described; containers 4 with the preheated ingots inside are withdrawn one at a time by robot 15 which, as it starts to move towards machine 5, determines the temperature of the ingot by means of thermocouple 51, this temperature check also provides for determining the presence or absence of an ingot inside the container withdrawn from furnace 3; and, after checking the thermocouple reading, control unit 45 provides for rotating head 50, at the appropriate time, about axis A, so as to tip container 4 downwards and unload ingot 2 selectively into injection chamber 6 or reject bin 20 (if the thermocouple reading is outside the established range).

In the event the ingot is rejected, control unit 45 reverses robot 15, which goes back to withdraw another container from furnace 3, and machine 5 is kept on standby; conversely, after first preheating half molds 8 to a temperature of 250°–350° C. (by means of heater plugs 60), control unit 45 activates machine 5 and commences the next withdrawal cycle by robot 15. For each operating cycle of machine 5, control unit 45 also provides for bringing half molds 8 together, after first lubricating them by means of robot 23; and, once mold 7 is closed, for activating pump 62 to withdraw the air (and any lubricant vapours) trapped between half molds 8 when closing mold 7, so that the semiliquid alloy is injected with a vacuum inside mold 7. Subsequently, half molds 8 are parted, and the casting is removed and loaded into store 21 by robot 22, leaving machine 5 ready for the next cycle.

Clearly, therefore, preheating ingots 2 in a number of parallel rows inside a forced-convection-heated tunnel furnace is essential for any system stoppages to be accommodated safely without all the ingots falling outside the, albeit relatively ample, permissible temperature range. In fact, without the use of extremely sophisticated, high-cost systems for controlling the temperature of the furnace, which are extremely difficult to implement in a mass production shop, other systems have surprisingly failed to store a sufficient number of ingots within the given temperature range to accommodate minor stoppages of system 1 (due to rejection of an ingot and/or other routine operating defects), or to prevent overheating of the ingots in the event of a number of minor stoppages in rapid succession.

The above drawback, however, is clearly eliminated by the forced-convection-heated furnace forming part of the present invention, by virtue of it operating at temperatures corresponding to the upper limit of the rheocast ingot acceptance range (with effective internal ventilation for ensuring a high heat exchange coefficient).

We claim:

1. A method of semiliquid die casting a metal alloy comprising:

placing a rheocast ingot of the metal alloy in a container;

preheating the metal alloy ingot to a semiliquid state in a forced-convection-heated furnace;

withdrawing the container and the preheated metal alloy contained therein from the furnace;

immersing a thermocouple in the metal alloy during transfer of the container from the furnace thereby determining whether the metal alloy is within an acceptable temperature range, said acceptable temperature range being dependent upon the composition of the metal alloy and ranging from a minimum permissible injection temperature at which the ingot begins to be visibly incapable of maintaining its shape to a maximum permissible injection temperature at which the metal alloy has an apparent viscosity such that the metal alloy may fill a mold under laminar flow conditions; and transferring the metal alloy from the container into an injection chamber operatively connected to the mold when the metal alloy is within the acceptable temperature range and rejecting the metal alloy when the metal alloy is not within the acceptable temperature range.

2. The method of claim 1 wherein the mold comprises at least two half molds facing and movable in relation to each other, each of the half molds having an independent preheating means for heating each respective half mold above ambient temperature when the metal alloy is injected into the half molds.

3. The method of claim 2 wherein the half molds are maintained at a temperature ranging between 250° C. and 350° C. when the metal alloy is introduced into the half molds.

4. The method of claim 1 wherein the mold comprises at least two half molds and the method further comprises:

lubricating the half molds; and forming a vacuum inside the half molds when the mold is in a closed position and prior to introduction of the metal alloy into the half molds.

5. The method of claim 1 wherein there is a plurality of ingots and containers and the preheating of the ingots is performed in a tunnel furnace, each ingot being housed inside a respective one of said containers, said containers being advanced through the furnace in a plurality of side by side rows; and said containers having means for maintaining a space between the ingot and an inner surface of the respective container whereby air is circulated about the ingot as long as the ingot is capable of maintaining an independent shape.

6. The method of claim 5 wherein the containers and the ingots contained therein are advanced by a first and second powered roller conveyor supporting said containers; the second roller conveyor being located at a furnace unloading station, said second roller conveyor being activated independently of the first roller conveyor and operatively connected to a sensor means whereby one container from each of said side by side rows may be aligned against a limit stop at the unloading station.

7. A system for semiliquid die casting a metal alloy comprising:

a tunnel furnace for preheating the ingots to a temperature within the solidification range of said metal alloy;

a plurality of containers for holding the ingots;

a first robotic handling device operatively associated with a loading station located at a first end of the tunnel furnace whereby said first robotic handling device places each ingot into a respective container and loads a side-by-side plurality of the ingots and respective containers on the loading station;

said loading station having means for simultaneously inserting said side-by-side plurality of ingots and respective containers into the furnace;

conveying means for conveying said side-by-side plurality of ingots and respective containers from said first end of said furnace to a second end of said furnace opposite said first end;

an unloading station located at the second end of the furnace; said unloading station having a limit stop for aligning said side-by-side plurality of ingots and respective containers;

a die casting machine comprising an injection chamber for receiving the preheated ingots one at a time and a mold having at least two half molds movable in relation to each other;

a second robotic handling device operatively associated with said unloading station, said die casting machine and a rejection bin; whereby said second robotic handling device removes said side-by-side plurality of ingots and respective containers located on said unloading station one ingot and respective container at a time and selectively transfers said one ingot of said side-by-side plurality from said respective container to the injection chamber of the die casting machine when the one ingot is within an acceptable temperature range and to said rejection bin when the one ingot is not within said acceptable temperature range; and a thermocouple which is immersed in the one ingot of said side-by-side plurality during transfer by the second robotic handling device whereby the temperature of the one ingot is determined prior to completion of the transfer of the one ingot.

8. The system of claim 7 wherein said half molds further comprise independent preheating means for maintaining the half molds above ambient temperature when the metal alloy is injected into the half molds.

9. The system of claim 7 further comprising:

a suction pump which forms a vacuum inside said half molds prior to injection of the metal alloy into the half molds; and a third robotic handling device which lubricates the half molds and removes finished components from the half molds.

10. The system of claim 7 wherein said conveying means comprises:

a first and second powered roller conveyor; said first and second roller conveyors being activated independently; and guide means for controlling transverse movement of the containers within the furnace comprising tabs which extend from the containers and engage grooves located in said first and second roller conveyors, said grooves extending in a travel direction.

11. A method of semiliquid die casting a metal alloy comprising:

placing a rheocast ingot of the metal alloy in a container;

preheating the metal alloy ingot to a semiliquid state in a forced-convection-heated furnace;

sensing a temperature of the metal alloy ingot;

withdrawing the container and the preheated metal alloy contained therein from the furnace when the metal alloy is within an acceptable temperature range, said acceptable temperature range being dependent upon the composition of the metal alloy and ranging from a minimum permissible injection temperature at which the ingot begins to be visibly incapable of maintaining its shape to a maximum permissible injection temperature at which the metal alloy has an apparent viscosity such that the metal alloy may fill a mold under laminar flow conditions; and transferring the metal alloy from the container into an injection chamber operatively connected to the mold.

* * * * *